United States Patent [19]

Pontvianne

[11] 4,337,413

[45] Jun. 29, 1982

[54] FOCUSING DEVICE WITH PERMANENT MAGNETS FOR ELECTRON TUBE AND ELECTRON TUBE EQUIPPED WITH SUCH A DEVICE

[75] Inventor: Jean Pontvianne, Paris, France

[73] Assignee: Thomson-CSF, Paris, France

[21] Appl. No.: 134,567

[22] Filed: Mar. 27, 1980

[30] Foreign Application Priority Data

Apr. 3, 1979 [FR] France ..... 79 08371

[51] Int. Cl.[3] ..... H01J 25/34

[52] U.S. Cl. ..... 315/3.5; 315/5.35; 315/39.3; 315/3.6

[58] Field of Search ..... 315/5.35, 3.5, 3.6, 315/39.3

[56] References Cited

U.S. PATENT DOCUMENTS 2,812,470 11/1957 Cook et al. ..... 315/3.5 X 2,947,907 8/1960 Bodmer ..... 315/3.5

3,448,329 6/1969 Meyerer et al. ..... 315/3.5

FOREIGN PATENT DOCUMENTS 2652020 5/1978 Fed. Rep. of Germany ..... 315/5.35

*Primary Examiner*—Saxfield Chatmon, Jr.

*Attorney, Agent, or Firm*—Roland Plottel

[57] ABSTRACT

A focusing device for an electron tube is constituted by alternating magnets and pole pieces in the form of washers, which are fixed against one another in such a way as to form a cylinder surrounding the envelope of the tube and being of the same axis as the latter, the electron beam propagating along said axis. The magnetized washers have a central hole and are interrupted over part of their circumference by an opening permitting their fitting between the pole pieces previously fixed to the envelope.

3 Claims, 3 Drawing Figures

FIG_1-a

FIG_1-b

FOCUSING DEVICE WITH PERMANENT MAGNETS FOR ELECTRON TUBE AND ELECTRON TUBE EQUIPPED WITH SUCH A DEVICE

BACKGROUND OF THE INVENTION

The present invention relates to a focusing device for an electron tube having permanent magnets.

In the electron tube field, such a device serves to oppose the natural divergence of the electronic beam, which could have the consequence that at least part of the latter would be intercepted by the parts of the tube traversed by it along its path. This would in turn be disadvantageous for the operation of the tube and in particular its efficiency.

This is more particularly the case with ultra-high frequency travelling wave tubes where the beam follows a long linear path between the cathode from which it is emitted and the collector by which it is collected.

The invention also relates to the electron tube equipped with such a device and in particular a travelling wave tube.

The present focusing devices are constituted by alternating permanent magnets and alternating pole pieces, fixed against one another about the vacuum envelope of the tube.

These pieces comprise flat circular washers having a hole in the centre thereof and when all of them are installed, a hollow cylinder is formed, whose axis coincides with that of the tube along which the electron beam is propagated. The magnetized washers have a magnetization perpendicular to their faces. In this way, the necessary magnetic field is obtained and its lines of force in the vicinity of the said axis have a component in the direction of the latter.

According to the prior art, the mounting of such focusing devices on the tube firstly involved the fitting of the pole pieces on the tube envelope, prior to the fitting of the electron gun, constituted by the cathode and the associated parts, of the collector and of the coupling antennas of the tube. This was followed by the magnets, previously split into two halves in order to permit their insertion between the pole pieces. The two halves in question were then fixed together by a clip to prevent them moving apart under the action of magnetic repulsion.

This procedure had a number of disadvantages. These were more particularly caused by the necessary breaking operation with the resulting demagnetizing action, the inevitable waste and the resulting loss of material. In addition, certain waste could even be attracted towards the assembly in the air gap and impair the homogeneity of the field. Another disadvantage was the necessity of a locking member for the two parts of each magnetized washer.

BRIEF SUMMARY OF THE INVENTION

The present invention relates to a focusing device for an electron tube making it possible to obviate the above disadvantages by the use of magnetized washers which are open over part of their circumference.

BRIEF DESCRIPTION OF THE DRAWINGS

The invention is described in greater detail hereinafter relative to non-limitative embodiments and the attached drawings, showing.

DETAILED DESCRIPTION OF THE PREFERRED EMBODIMENTS

Figure 1:
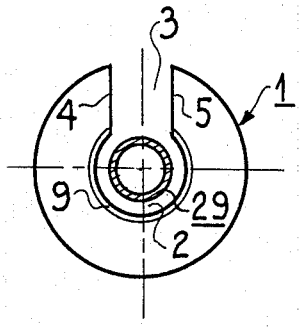
FIGS. 1*a* and 1*b* plan and profile views of a magnetized washer of the focusing device according to the invention.
Figure 1:
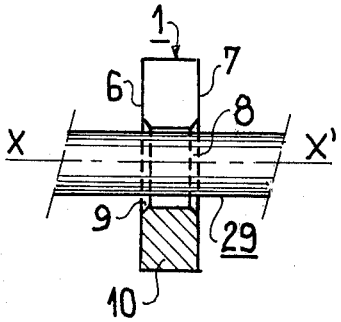

FIG. 1*a* shows in plan view one of the magnetized washers or elementary magnet of the focusing device according to the invention. According to the present embodiment, the elementary magnet comprises a flat circular washer 1 having in its centre a circular hole 2. Washer 1 is interrupted over part of its circumference by an opening 3, limited to two planar sections which are parallel to one another, designated by the reference numerals 4 and 5 and which are also perpendicular to the washer faces. These sections, in the present embodiment, are spaced by a distance less than the diameter of the central hole of the washer. This diameter exceeds the diameter of the envelope of the tube on which they are mounted.

FIG. 1*b* shows a section through the plane passing along axis XX′ of the washer and and the centre of the opening 3. In this drawing, the section of the washer is the part covered by hatching. Axis XX′ coincides with that of the tube on which is mounted the focusing device to which the washer in question belongs. The latter is magnetized perpendicular to its faces 6 and 7, i.e. parallel to axis XX′. On each face of the washer, the edge of the central hole has a chamfer 8, 9.

The fitting of the magnetized washers between the pole pieces is carried out by engaging the washer about the envelope of the tube by the opening 2. Thus, the breaking operation, whose disadvantages were referred to hereinbefore is rendered superfluous. The washer is removed by a movement in the opposite direction. The envelope has been shown in the drawings.

Moreover, once the magnetized washers have been fitted, it is possible to place magnet parts in the openings 3 to modify the magnetic field of each washer.

The pole pieces are designed and their permeability chosen in such a way as to obtain the homogeneity of the magnetic field along the axis, despite the asymmetry of the magnetized washers. They must be in a state of non-saturation for the average flux passing through them.

The open magnetized washers of the device according to the invention are made from a magnetic alloy. They can also be made from a plastics material or an elastomer, filled or charged with such an alloy in powder form.

Although a specific embodiment has been described, other variants which are adapted to the particular case are also possible. All these variants are covered by the invention.

Figure 2:
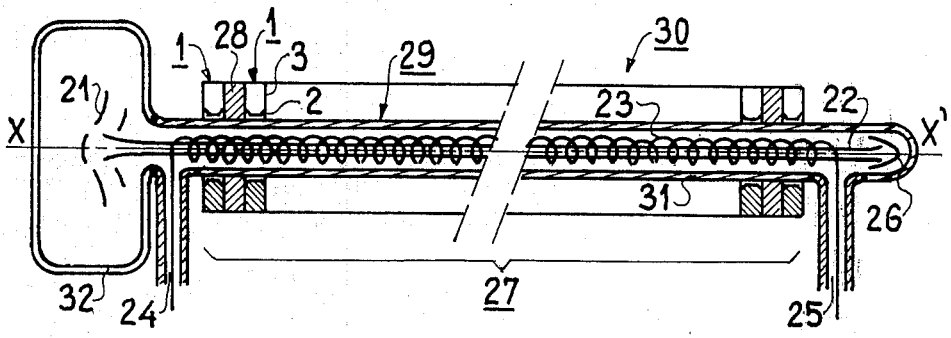
FIG. 2 a diagrammatic view of an electron tube equipped with a focusing device according to the invention.

FIG. 2 is a diagrammatic view of a travelling wave tube 30 incorporating a focusing system according to the invention. FIG. 2 shows the electron gun, designated overall by the reference numeral 21 and constituted by a cathode and two electrodes for controlling and accelerating the electron beam 22, limited to the two lines visible in the drawing and parallel to axis XX', along which the latter is propagated to the collector by which it is intercepted. Reference numeral 23 designates the helical delay line and numerals 24 and 25 the coupling means at the inlet and outlet of the tube. The focusing device is 27 and comprises the alternation of magnetic washers such as 1 and pole pieces 28. The latter are fixed to the envelope 29 formed from a metallic part 31 and an insulating part 32 containing the gun.

When it is necessary, the device according to the invention also permits the installation of parts of a cooling system at the openings of the washers.

What is claimed is:

1. A focusing device for an electron tube comprising alternating permanent magnets and pole pieces in the form of flat washers having a central hole and fixed against one another around the envelope of the tube in the electron beam propagation direction, wherein the permanent magnetic washers are open over part of their circumference, the spacing between the edges of the opening being sufficient to permit the passage of the envelope.

2. A focusing device according to claim 1, wherein the edges of the opening consist of two straight sections of the washer, which are parallel to one another and separated by a distance less then than the diameter of the circular central hole.

3. An electron tube and in particular a travelling wave tube, incorporating a focusing device according to either one of claims 1 or 2.

* * * * *